United States Patent [19]

Yates

[11] Patent Number: 4,471,753

[45] Date of Patent: Sep. 18, 1984

[54] METHOD AND APPARATUS FOR BURNING SOLID FUELS IN A COMBUSTION CHAMBER

[76] Inventor: Harold P. Yates, 1 Mt. Prospect Rd., Bernards Township, Far-Hills County, N.J. 07924

[21] Appl. No.: 233,558

[22] Filed: Feb. 11, 1981

[51] Int. Cl.[3] ..... F24H 3/02

[52] U.S. Cl. ..... 126/110 R; 126/112; 126/103; 126/76; 126/108

[58] Field of Search ..... 126/285 A, 386, 297, 126/296, 99 D, 64, 75, 76, 112, 103, 74, 400, 110 R, 110 A

[56] References Cited

U.S. PATENT DOCUMENTS

| | | | |
|---|---|---|---|
| 5,307 | 9/1847 | Backus | 126/126 |
| 253,144 | 1/1882 | Willi . | |
| 628,272 | 7/1889 | Lynott . | |
| 665,436 | 1/1901 | Heuer . | |
| 1,305,755 | 6/1919 | Terry | 126/104 A |
| 1,688,763 | 10/1928 | Tielkemeyer . | |
| 1,954,923 | 4/1934 | Eichhorn . | |
| 2,385,652 | 9/1945 | Rifle . | |
| 2,579,213 | 12/1951 | Stuckey et al. . | |
| 2,594,834 | 4/1952 | Wilson | 126/108 |
| 2,676,583 | 4/1954 | Blumson . | |
| 4,102,318 | 7/1978 | Runquist . | |
| 4,299,178 | 11/1981 | Wilson | 126/400 |

FOREIGN PATENT DOCUMENTS

| | | | |
|---|---|---|---|
| 927078 | 1/1951 | France | 126/69 |

OTHER PUBLICATIONS

Ashley Automatic Heater Company, Sheffield, Alabama, "Burn Wood . . . Live Modern–with the Amazing Ashley".

Mohawk Industries, Inc., Adams, Maine, (1979), "House Warming with Mohawk".

Sarco Corporation, (1979), "Furnaces and Boilers".

Sarco Corporation, (1979), "Radiants".

Energy Marketing Corporation, (1979), Bennington, Vermont, "Buyer's Guide to Woodstoves".

Energy Marketing Corporation, Bennington, Vermont, (1979), "Vermont DownDrafter", (2 pamphlets).

Energy Marketing Corporation, (1979), Bennington, Vermont, "Home Heater".

Mohawk Industries, Inc., (1980), Adams, Maine, "Temp Wood Product Information".

Smoky Mountain Enterprises, Inc., (1980), Asheville, N.C., "I Didn't Know That".

Smoky Mountain Enterprises, Asheville, N.C., (1980), "The Last Thing You'll Ever Need to Read About High Heating Costs".

The Christian Science Monitor, Oct. 1, 1980, "Why Wood Burns, How a Good Stove is Made".

The Christian Science Monitor, Oct. 14, 1980, "An Airtight Case for America's Finest Wood and Coal--Burning Stoves".

The Christian Science Monitor, Jan. 28, 1981, "Wood Savings: Burn the Smoke, Too".

*Primary Examiner*—Samuel Scott
*Assistant Examiner*—G. Anderson
*Attorney, Agent, or Firm*—Martha G. Pugh

[57] ABSTRACT

A burning method and apparatus, using solid type fuel, comprising a combustion chamber in combination with a heat-extractor labyrinth chamber through which an artificial draft is generated mechanically. The artificial draft can be generated by intake and exhaust fans and/or blowers operating at accurately controlled speeds.

In a specific stove-type embodiment, the draft-flow within the combustion chamber is utilized by a reversal of its flow pattern for either conventional up-draft burning, or preferably, for down-draft burning, with the gases exiting through the heat extractor compartment at close to ambient temperature and a short horizontal flue into the atmosphere. In this embodiment, the intake fan also serves to distribute usable heat from the surfaces of the combination and heat extractor compartments.

2 Claims, 4 Drawing Figures

METHOD AND APPARATUS FOR BURNING SOLID FUELS IN A COMBUSTION CHAMBER

BACKGROUND OF THE INVENTION

This invention relates in general to techniques and apparatus improving combustion and heat extraction in units using solid type fuel, such as stoves, furnaces and combustion chambers.

Heretobefore, solid type fuel burning units have used a natural flow of primary air upward through a fire bed to support the combustion process. In order to develop and continue combustion in prior-art units using a natural draft system, high temperature exhaust gases are required to move from the combustion process into and up a vertical chimney to develop a partial vacuum in the combustion chamber to draw in air to sustain combustion. This natural draft system results in a continuous waste of high cost heat energy which cannot be used for useful heating purposes.

Also, these prior-art units use a primary source of air which flows up through the fire bed from below, allowing burnt and unburnt gases to escape without complete combustion. In addition to limiting the burning efficiency of the unit, these partially burnt exhaust gases can cause chimney problems by cooling and forming 'creosote' deposits on the walls of the chimney. This can result in a fire and safety hazard if not periodically removed.

In the prior-art, numerous attempts have been made to increase the burning efficiency of heating units. Down-drafting has been attempted wherein a secondary flow of air is introduced above the fire bed, forcing combustion gases back toward the fire bed. Because of the upward flow of primary air, these combustion gases usually exit at the top or sides of the fire bed. While this method has resulted in some increase in burning efficiency, it still does not take full advantage of the genuine down-draft developed by Benjamin Franklin, the principal of which uses the primary source of air entering above the fire bed and exiting below the grate, and then flowing downward and through the fire bed for optimum heat release of solid fuel and volatile energies. These prior-art units still require a vertical chimney for draft development.

Any annual heating bill includes numerous hidden costs, such as for the purchase and maintenance of the heating unit and required accessories plus the uncertain heat return per fuel cost dollar. As an example, a conventional heating device demands a vertical chimney as a necessary component of the burning progression; and this component is costly to construct, maintain and repair. These hidden investments must be added to the annual fuel bill. In addition, these costs are substantially increased by the fact that a conventional wood burning stove is acknowledged to be only about 50% or less fuel return efficient, partly because heat is continually wasted to generate an elevated temperature of about 204° Celsius to create a natural chimney draft, and a goodly portion of unburnt volatile energy goes up the chimney without contributing to useful heating.

SUMMARY OF THE INVENTION

Accordingly, it is the broad object of the invention to improve the efficiency and increase the economy of operation for solid type fuel burning devices.

A more particular object of the invention is to increase the percentage of usable heat return that can be extracted from the inherent heat values of the fuel being burnt by better burning practices and by insuring that the temperature of exhaust gases exiting from the heating device does not substantially exceed the ambient temperature.

A further object of the invention is to provide a stove for heating residences and other closed areas by the burning of solid fuel, which is more fuel efficient than the stoves of the prior-art.

These and other objects are realized in accordance with the present invention in a combustion chamber for solid fuel having intake and exhaust flues wherein the flow of air through the fire bed is mechanically induced, and accurately controlled.

In a preferred form of the invention, means is provided for mechanically reversing the usual upward flow of air through the fire bed in the combustion chamber. This air flow, regardless of the direction, can be developed by a fan attached to an intake duct which serves to force air into the combustion chamber and ultimately to force the cooled exhaust gases from a heat extraction compartment adjacent the combustion chamber into an outside dispensing atmosphere. In addition, or as an alternative, a fan may be connected to the exhaust flue instead of, or to supplement, the action of the intake fan in moving the burnt exhaust gases out of the heating device.

Thus, an artificial draft is created which can be accurately regulated by the action of these fans, either acting in concert, or independently. By this accurate mechanical control of the draft flowing into and out of the combustion chamber a higher degree of burning efficiency can be obtained at any desired burning rate.

In a disclosed embodiment, a heating device comprising a box-type stove unit is constructed with a combustion chamber including a fire-grate suitable for burning the desired type of solid fuel. Air is forced through the fire bed by an airflow system comprising an intake fan interposed at the rear of the combustion chamber which is formed with upper and lower slots, above and below the fire grate, including dampers constructed to be alternatively opened or closed to produce either genuine down-draft burning as taught by the present invention, or in the alternative, up-draft burning. In either case, hot burnt gases are forced out through conduits into a pair of heat extractor compartments spaced apart on opposite sides of the combustion chamber. These hot combustion gases then journey through a labyrinth formed, for example, by a series of baffles contained within these two heat extractor compartments, which serve to slow the travel of the hot gases, and greatly increase the recoverable heat to be made available for useful heating. These heat extractor compartments may take numerous forms, and may be surrounded by either liquid or solid thermal storage material. The gases leave the heat extractor compartments at a moderate temperature not exceeding about 20° to 35° Celsius, since elevated temperatures are not required to develop a natural draft in a chimney.

The intake fan also serves to blow cool air into the spaces between the combustion chamber and the heat extractor compartments which is thereby heated and distributed as warm air. The moderate temperature exhaust gases which are expelled from the heat extractor compartments in this artificial draft progression then move into an exhaust duct for final disposal in an outside atmosphere. This exhaust duct, normally of short length and horizontally positioned, terminates in an exhaust fan assembly and, if desired, a conventional screened receiver-scrubber unit of a type well-known in the art to retain unwanted particles and gases from being discharged into the outside atmosphere. Various methods are disclosed for initially bringing the fuel and the atmosphere in the combustion chamber to the combustion temperature.

Among the advantages to be realized in heating devices constructed in accordance with the principles of the present invention is that they are more fuel efficient and that the heat chimney or stack is eliminated. Further, in the mode of operation in which the forced air draft is directed downward and through the fire bed in a reverse direction from the natural upward flow of heat, more effective combustion occurs because an optimum volume of oxygen is available throughout the combustion area for maximum heat release from the burning of both solid fuel and the emerging volatiles.

Further advantages to be realized in the use of heating devices constructed in accordance with the present invention are the elimination of the need of a vertical chimney, which is a substantial expense to construct; and the elimination of waste of high temperature exhaust gases continuously passing out through such a chimney.

Another advantage of a stove-type embodiment constructed in accordance with the teachings of the present invention is that it can be placed adjacent to any outside wall.

These and other objects, features and advantages of the invention will be better understood by a study of the detailed description hereinafter with reference to the attached drawings.

SHORT DESCRIPTION OF THE DRAWINGS

DETAILED DESCRIPTION OF THE INVENTION

The method and apparatus in accordance with the present invention for developing maximum heat return burning in a combustion chamber, employing a mechanically developed artificial draft, will be described by way of illustration with reference to a particular stove-type unit shown and described in FIGS. 1 through 4.

Figure 1:
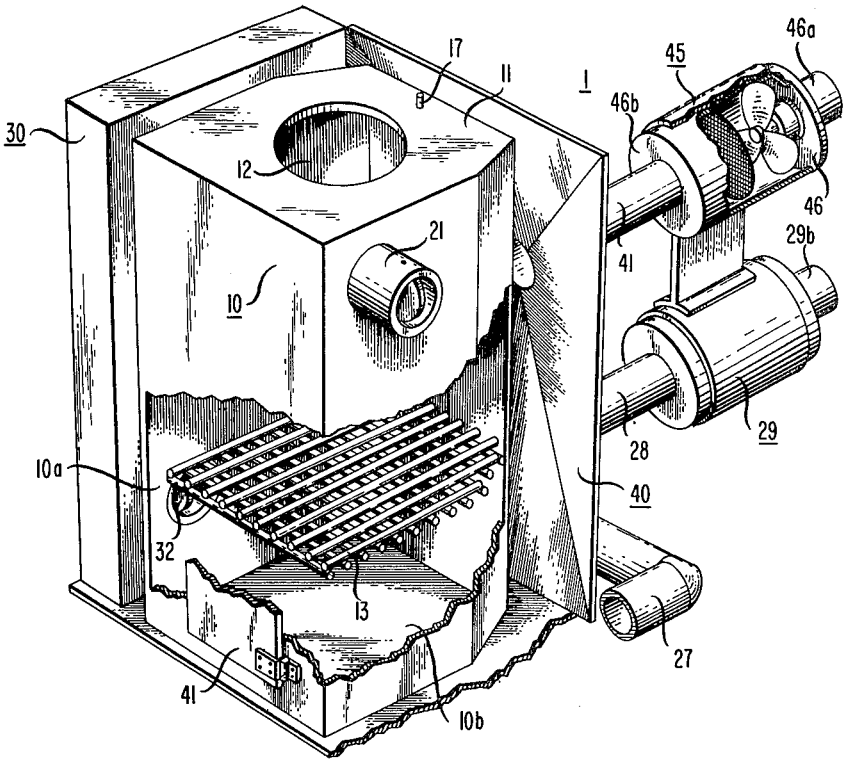
FIG. 1 shows a stove-type unit of the present invention with one of the heat extractor compartments removed and the combustion chamber partially broken away exposing the fire grate.
Figure 2:
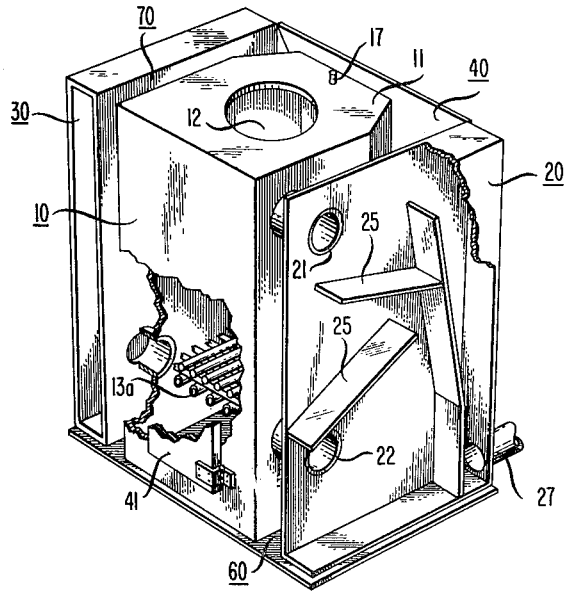
FIG. 2 shows the unit of FIG. 1 with one of the heat extractor compartments partially broken away exposing the labyrinth within.
Figure 3:
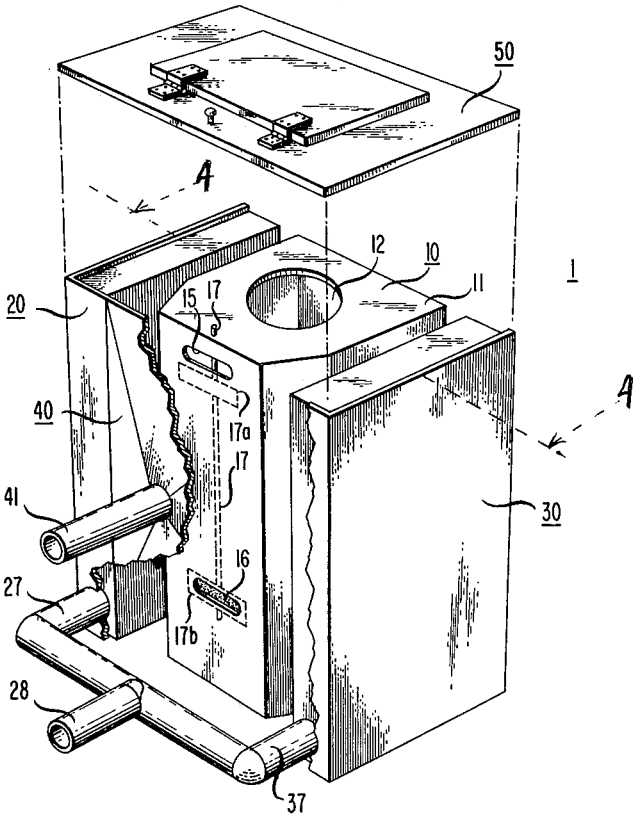
FIG. 3 shows, in rear perspective, the unit of FIGS. 1 and 2 with the air-intake chamber partially broken away, exposing the rear wall of the combustion chamber.

FIGS. 1, 2 and 3, show a stove-unit 1 in accordance with the present invention comprising a box-type housing, which, in the embodiment under description, is formed primarily of cast iron or other suitable material and includes a combustion chamber 10, comprising both the burning area 10*a* and the ash pit area 10*b*, heat extractor compartments 20 and 30 and air-intake chamber 40.

In the present example, the combustion chamber 10 comprises a box-type, formed of cold rolled steel sheets, say $\frac{1}{8}$ inch thick and 32 inches high, by 20 inches wide, by 20 inches deep, the rear portion being tapered to a width of 14 inches. The particular shape of chamber 10 is shown, only by way of example; it is contemplated that other chamber shapes, such as circular, may be employed. Typically, regardless of the shape, chamber 10 is provided with an internal capacity totaling, about 7 cubic feet. The top panel 11 of chamber 10 has a substantially centered circular opening 12, about 14 inches in diameter, for inserting wood, coal, or other solid type fuel into the stove. A suitable fire grate 13, disposed parallel to and about 10 inches above the bottom of chamber 10, is designed to hold the fuel which forms a fire bed during the burning process. Grate 13 comprises a horizontally disposed fixed or shakeable grill formed of an open mesh of iron rods, about $\frac{1}{2}$ inch in diameter, and spaced-apart about 1 inch to permit the flow of air or volatile combustion by-products and ashes through the grate. An ash door 14, say 12 inches wide and 5 inches high, located on the front of combustion chamber 10, below grate 13, opens, to allow removal of ash resulting from the burning process. If desired, ashes can be directed to fall into an ash receiver tray supported 1 inch above the bottom panel of combustion chamber 10. This will permit the emerging volatile combustion by-products to heat this surface, providing another source of useable heat if air from the intake chamber 40 is flowed across the outside of this panel. In one alternative, as shown in FIG. 2, fire grate 13 comprises a plurality of tubes 13*a*, directed from front to back, secured on to the respective chamber panels, and each having an internal diameter of 1 inch, and spaced-apart 1 inch. Tubes 13*a* allow air, heated by the combustion process, to be blown through from outside of the back to and from the front wall of the combustion chamber 10, to provide additional useable warmth.

In the rear wall of combustion chamber 10 (FIG. 3) is a pair of horizontally directed slots 15 and 16 which are centrally located and vertically aligned about 22 inches apart. Each of the slots 15 and 16 has a width of 12 inches and a height of $1\frac{1}{2}$ inches, and can be opened or closed to allow air to enter the combustion chamber 10.

Located 2 inches apart on opposite sides, parallel to the lateral walls of combustion chamber 10, and spaced-apart therefrom to provide intervening channels 70 and 60, (FIG. 4) is a pair of heat extractor compartments 20 and 30, each of which is rectangular in shape, having a height of 32 inches, a width of 4 inches and a depth of 24 inches. A pair of ducts 21 and 22, (see FIG. 2) having an inner diameter of 4 inches, located one above the other, spaced 20 inches apart, near the front top corner and front bottom corner on the side of combustion chamber 10 serve to connect its interior to right heat extractor compartment 20. A second pair of similarly placed ducts 31 and 32 (see FIG. 4) connect combustion chamber 10 to the left heat extractor compartment 30. Ducts 21, 22 and 31 and 32 can be opened and closed by a conventional damper (denoted as 21*a* in tube 21, 22*a* in tube 22, etc.) located inside each duct. The operation of the dampers will be described in detail with reference to FIG. 4 hereinafter.

Right heat extractor compartment 20 is equipped with a plurality of baffles 25 forming a labyrinth which segments its interior. Left heat extractor compartment 30 includes a similar labyrinth 35 (not shown). It will be understood that the baffles 25 are shown by way of example, and other means or arrangements for creating a labyrinth, such as a series of conduits, can perform the same function. It is contemplated, if desired, that the labyrinths comprising heat extractor compartments 20 and 30 can be surrounded by thermal storage material, either liquid or solid, such as, for example, water, Therminol fluid, Glauber's salt, sodium thiosulphate or other heat absorbing materials which function to permit the heat of said hot exhaust gases to be transferred therefrom and to be dissipated as useful heat over an extended period of time, so that exhaust gases leave the heat extractor chambers at moderate temperatures not exceeding temperatures about in the range from 20° to 35° Celsius.

The purpose of the labyrinth configuration is to increase the distance and time path that hot combustion gases, entering for either of ducts 21, or 22, and 31 or 32 on the other side, must travel before exiting at the lower rear of heat extractor compartment 20, or its mate 30. An exhaust duct 27, which is disposed near the rear lower corner of the heat extractor compartment 20, (similar to exhaust duct 37 of heat extractor compartment 30, having an internal diameter of 4 inches, allows the escape of the now low temperature combustion gases. Exhaust ducts 27 and 37, which are directed to the rear, are both located about, say, 3 inches from the bottom of the respective heat extractor comparments. Each of exhaust ducts 27 and 37 extend 6 inches and are connected at the rear of the above unit in a "T" connection, to form a single short horizontal exhaust flue 28, terminating into the exhaust fan or blower 29. The outlet 29*b* of said exhaust fan or blower is attached to a final exhaust flue of such length as to extend from the heating device to an outside atmosphere. If desired, such flue can be terminated in a screened receiver-scrubber unit to retain the emission of undesirable gases or particles.

Shown, partially broken away in FIG. 3, enclosing the rear of both the combustion chamber 10 and the pair of heat extractor compartments 20 and 30, is an air-intake chamber 40, which is roughly rectangular in shape, extending about, say 4 inches from the rear of combustion chamber 10. Centrally located, and externally directed from the rear wall of intake chamber 40 is an intake duct 41, having an inner diameter of 4 inches and a length of 6 inches.

Intake duct 41 is attached to a conventional fan or blower 45 which imparts an artificial draft into the stove-unit 1. Fan 45 is encased in housing 46, having a rear opening 46*a* for the intake of cool air, and a front opening 46*b* which attaches to intake duct 41. Fan 45 can be driven electrically by a motor powered by conventional alternating current source, of, say, 110 volts, or alternatively by a 12 volt storage battery. In the example under description the fan has 5 inch blades for this particular chamber 10, having a capacity of about 7 cubic feet, and is, in the present example, driven by a motor of about a 18 watt rating. However, any method of mechanically developing an artificial draft can be used.

In addition to the intake fan 45, an exhaust fan assembly 29, which is similar to intake fan 45, but oppositely directed, can be attached to the single horizontal exhaust duct 28. By the regulation of both intake and exhaust fans 45 and 29, the draft, flowing through the combustion chamber 10, can be controlled and modulated. For example, if the speed of the intake fan 45 is increased, without increasing the speed of exhaust fan 29, and increased concentration of air and oxygen will build up in the combustion chamber 10. This will maximize fuel heat efficiency of combustion at any desired burning rate.

The air flow generated by fan 45, in addition to inducing air into the combustion chamber 10 through slots 15 and 16, is also used to move air heated by the combustion process and radiated from the combustion chamber 10 and heat extractor compartments 20 and 30; through channels 60 and 70 which are formed between the side walls of combustion chamber 10 and the inner walls of heat extractor compartments 20 and 30.

The draft movement of unit 1 can best be described with reference to FIG. 4. With damper 17 in the down-draft position, attached metal cover 17*a* opens the slot 15, and metal cover 17*b* closes slot 16. A draft, created by fan 45 will enter combustion chamber 10 through slot 15. Air reaches the fire bed from above, as shown by the arrows on the right half on FIG. 4, (which indicates the stove in down-draft condition) forcing the naturally rising combustion gases back down through the fire bed and out below the bed. This genuine "down-drafting" system results in a more complete, efficient burning of both the solid fuel and volatile combustion by-products, thereby serving to increase heating efficiency.

When employing the genuine down-drafting burning progression, upper ducts 21 and 31 are closed by a second pair of conventional dampers 21*a* and 31*a;* and lower ducts 22 and 32 are open, forcing the downward-directed air and volatile combustion by-products out through the latter and into compartments 20 and 30. The hot combustion gases are then channeled through the labyrinths 25 and 35 in heat extractor compartments 20 and 30 respectively, and exit at a temperature within the range 20° to 35° Celsius through lower horizontally directed ducts 27 and 37 and exhaust flue 28, for dispersion in an outside atmosphere through a supplementary length of flue, attached to the outlet of fan 29*b*.

Intake fan 45, which imparts an air flow through intake duct 41 and intake chamber 40, also serves as a fan to disperse in channels 60 and 70 the hot air which has been heated by heat exchange with the combustion chamber 10 and heat extractor compartments 20 and 30, and also through grate 13*a*.

Figure 4:
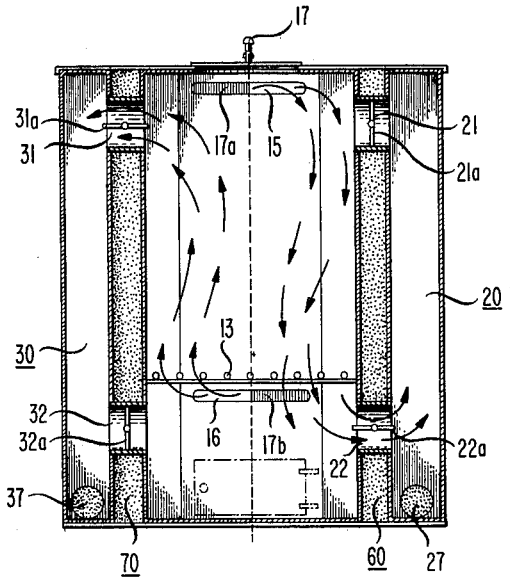
FIG. 4 is a vertical cross-section taken through FIG. 3 at lines 4—4 showing, on the right half, the unit with dampers set for 'down-draft' burning as taught by the present invention, with the arrows indicating the downward flow of air through the fire bed; and the left half showing conventional up-draft burning.

In the alternative, stove-unit 1 may operate on a conventional up-draft principal, as indicated by the arrows on the left half portion of FIG. 4. With damper 17 in an up-draft position, cover 17*a* closes slot 15 and cover 17*b* opens slot 16. The draft created by fan or blower 45 then enters combustion chamber 10 through the lower slot 16 and penetrates the fire bed from below, in a conventional manner. The naturally rising combustion gases exit from combustion chamber 10 through the open upper ducts 21 and 31 (lower ducts 22 and 32 being closed by dampers 22*a* and 32*a*). The hot combustion gases then are channeled through heat extractor compartments 20 and 30 and exit through exhaust ducts 27 and 37, as described above, again at low temperatures, of the order of from 20° to 35° Celsius.

The unit of FIGS. 1 through 4 is shown only as one example of how to employ the completely artificial mechanically developed draft system of the present invention. It is contemplated that genuine artificial draft, can have applications other than as described. For example, a device, in accordance with the present invention, can be used to heat water or generate steam or as a cooking unit.

It will be understood that the invention is not limited to the specific form of system, shown by way of illustration, but only by the scope of the appended claims.

What is claimed is:

1. A heating unit for heating a preselected area comprising a housing enclosing a combustion chamber having air intake means constructed and arranged to contain a quantity of solid fuel for burning;

means comprising a separate chamber adjacent to said combustion chamber, said separate chamber including an intake opening and a substantially horizontal exhaust vent, and no attached vertical chimney, and a heat extracting labyrinth comprising a heat absorbing path connected therebetween, said intake opening connected to said combustion chamber to receive the combustion products therefrom;

the sole means for producing a draft in said heating unit comprising mechanical means including one or more fans disposed therein and constructed and arranged to create a pressure differential between the air intake means of said combustion chamber and the exhaust vent of said heat extraction labyrinth for generating and directing a controlled stream of gas, containing a substantial component of oxygen, into said combustion chamber in a direction to pass through said quantity of fuel for promoting the complete burning of said fuel, and for moving the products of said burning at an input temperature substnatially above ambient temperature out of said combustion chamber, and to direct said combustion products through said separate chamber including said heat extraction labyrinth along said heat absorbing path, said path being constructed and arranged to absorb along its length a major proportion of the heat of said combustion products for radiating usable heat and warmth from said separate chamber into said preselected area, and to vent said combustion products to the atmosphere through said exhaust vent at a temperature not exceeding about 20°-35° Celsius, thereby effectively utilizing the heat of said combustion products.

2. The combination in accordance with claim 1 wherein said mechanical means is constructed to generate and direct said stream of gas to pass through said quantity of fuel in a down-draft direction.

* * * * *